US005676628A

United States Patent [19]

Chen

[11] Patent Number: 5,676,628

[45] Date of Patent: Oct. 14, 1997

[54] MULTIPURPOSE FITNESS MACHINE

[76] Inventor: Wu Tsung Chen, 7, Lane 279, Hsi Men Road Sec. 1, Tainan, Taiwan

[21] Appl. No.: 791,647

[22] Filed: Nov. 25, 1996

[51] Int. Cl.[6] ..... A63B 21/00

[52] U.S. Cl. ..... 482/142; 96/72

[58] Field of Search ..... 482/142, 95, 96, 482/72, 131

[56] References Cited

U.S. PATENT DOCUMENTS

| | | | |
|---|---|---|---|
| 4,489,936 | 12/1984 | Dal Monte | 482/96 |
| 5,507,709 | 4/1996 | Wu | 482/96 |
| 5,527,249 | 6/1996 | Harris | 482/96 |
| 5,575,741 | 11/1996 | Fan | 482/96 |
| 5,580,340 | 12/1996 | Yu | 482/96 |
| 5,582,563 | 12/1996 | Fan | 482/96 |

*Primary Examiner*—Jerome Donnelly
*Attorney, Agent, or Firm*—Pro-Techtor International

[57] ABSTRACT

A multipurpose fitness machine including a substantially U-shaped supporting frame having a transverse frame section and two longitudinal frame sections respectively connected in parallel to two opposite ends of the transverse frame section at right angles, a bench pivoted to the longitudinal frame sections of the U-shaped supporting frame at one end and having two longitudinal racks at the bottom side, and an operating frame unit adapted for supporting the bench on the U-shaped supporting frame for turning by hand to lift the bench from the U-shaped supporting frame when the user sits, lies, or stands on the bench.

4 Claims, 12 Drawing Sheets

MULTIPURPOSE FITNESS MACHINE

BACKGROUND OF THE INVENTION

The present invention relates to fitness machines, and more particularly to a multipurpose fitness machine which is practical for exercising different parts of the body and, which can be conveniently adjusted to fit different users.

A variety of fitness machines including rowing machines, step machines, standing bicycles, etc., have been disclosed for exercising a particular part of the body, and have appeared on the market. Because these fitness machines are respectively designed for a particular purpose, they cannot satisfy different demands for exercising different parts of the body. Furthermore, these fitness machines are commonly heavy, expensive, and complicated.

SUMMARY OF THE INVENTION

It is one object of the present invention to provide a fitness machine which is practical for exercising different parts of the body. It is another object of the present invention to provide a multipurpose fitness machine which can be conveniently adjusted to fit different users. It is still another object of the present invention to provide a multipurpose fitness machine which is simple in structure, and inexpensive to manufacture. According to one aspect of the present invention, the multipurpose fitness machine comprises a substantially U-shaped supporting frame having a transverse frame section and two longitudinal frame sections respectively connected in parallel to two opposite ends of the transverse frame section at right angles, a bench pivoted to the longitudinal frame sections of the U-shaped supporting frame at one end and having two longitudinal racks at the bottom side, and an operating frame unit adapted for supporting the bench on the U-shaped supporting frame for turning by hand to lift the bench from the U-shaped supporting frame when the user sits, lies, or stands on the bench. According to another aspect of the present invention, the operating frame unit comprises a U-bar, a cross bar connected between the U-bar, and two oars respectively connected to the two opposite ends of the cross bar and the two opposite ends of the U-bar by a respective ratchet connector, which permits the angular position of the respective oar to be adjusted relative to the U-bar. According to still another aspect of the present invention, each of the oars is comprised of two sections that slide one inside the other and adjustably locked by lock means for example a screw bolt. According to still another aspect of the present invention, the U-shaped supporting frame is made retractable, so that its size can be minimized when the multipurpose fitness machine is not in use.

DETAILED DESCRIPTION OF THE PREFERRED EMBODIMENT

Figure 1:
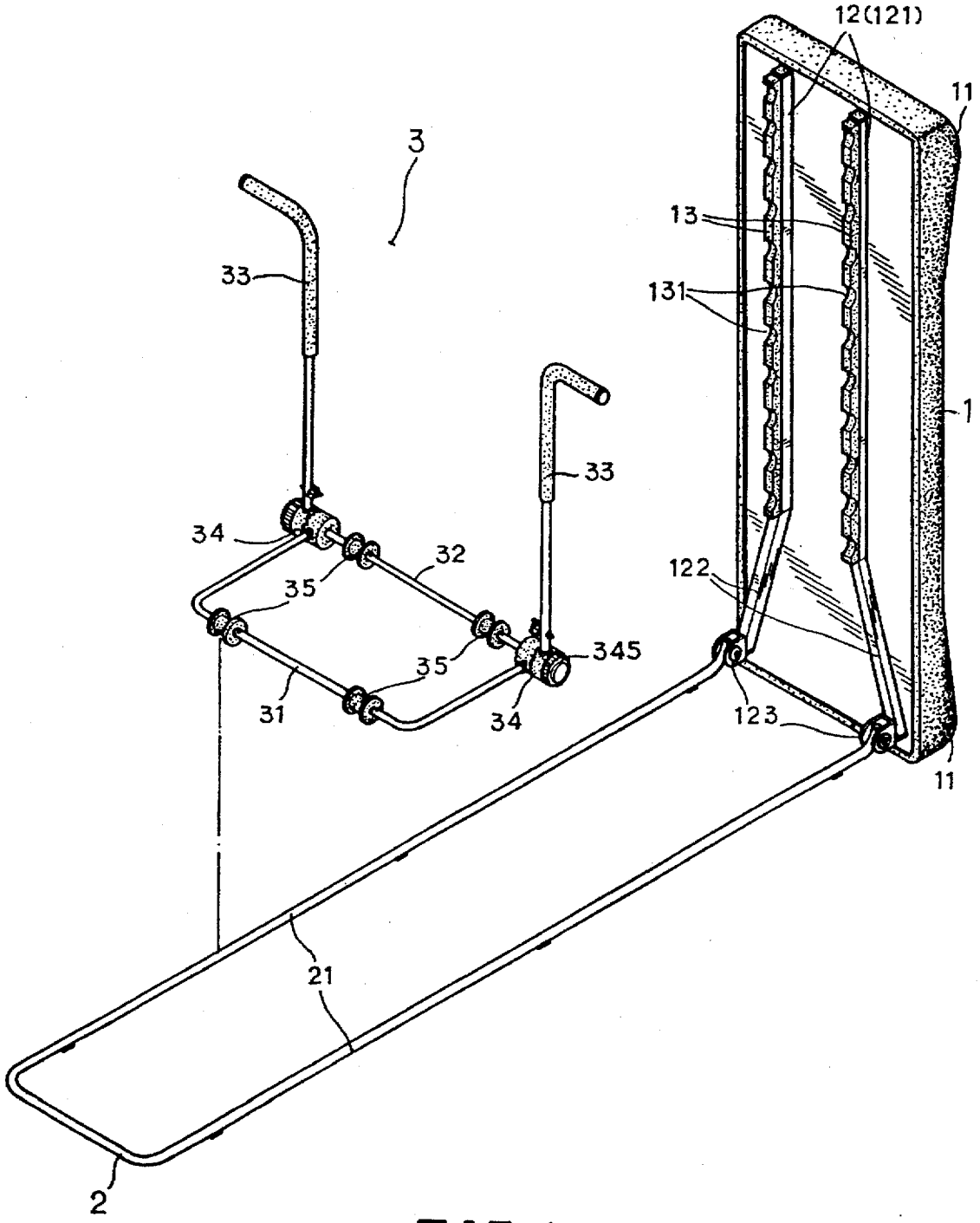
FIG. 1 is an elevational view of a multipurpose fitness machine according to the present invention.
Figure 2:
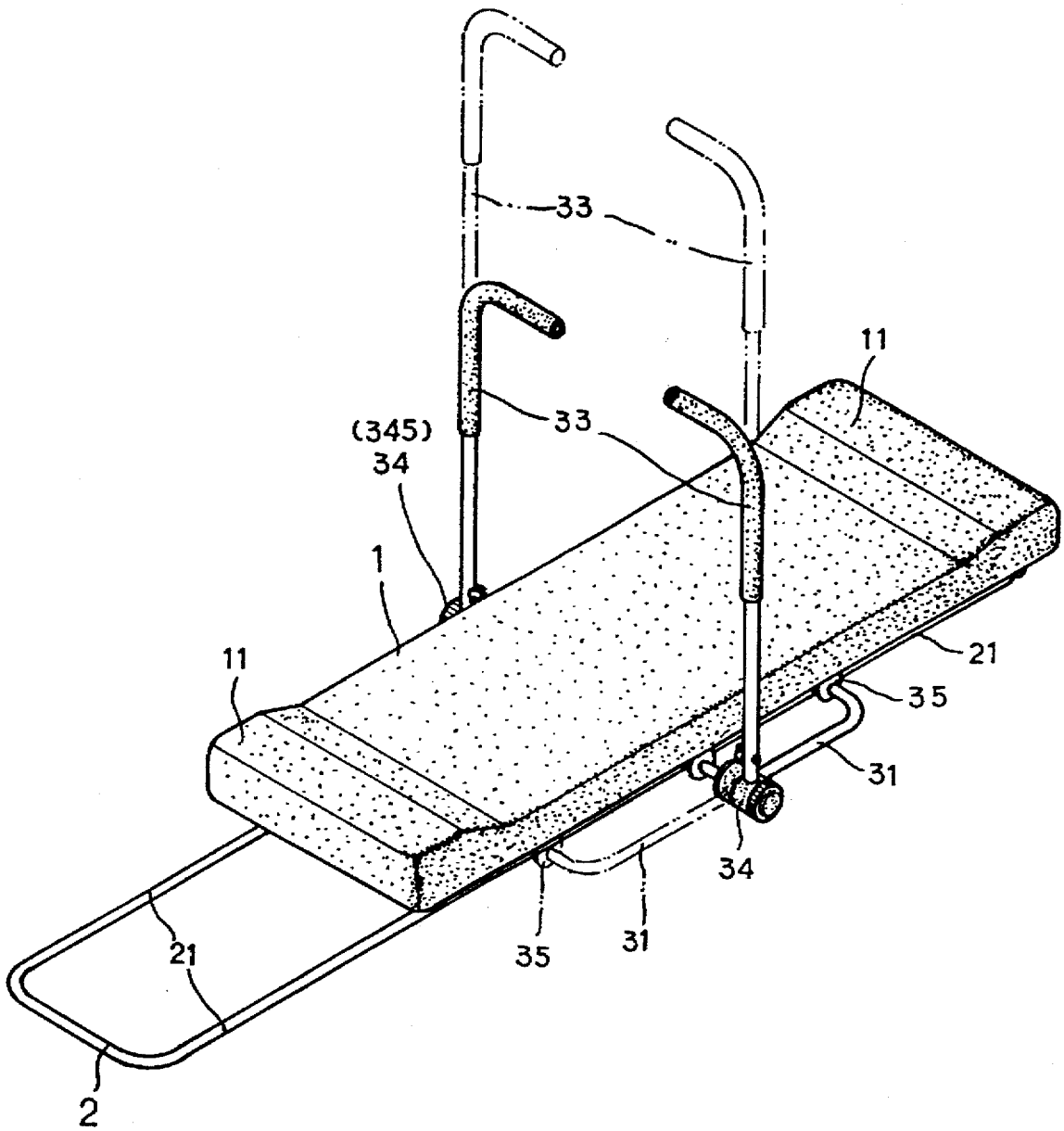
FIG. 2 shows the operating frame unit of the multipurpose fitness machine adjusted according to the present invention.
Figure 3:
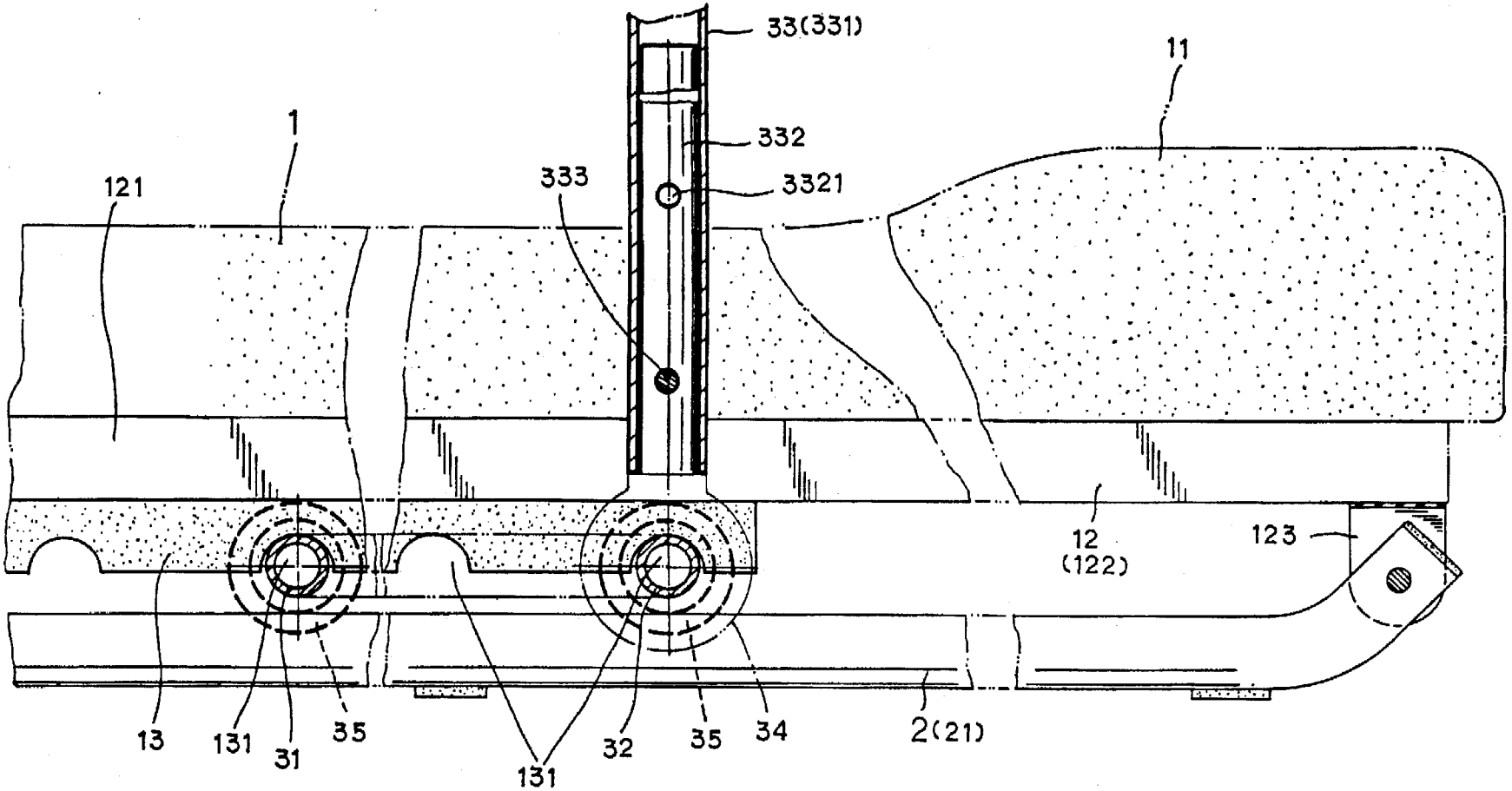
FIG. 3 is a sectional assembly view in an enlarged scale of a part of the present invention.

Referring to FIGS. 1, 2, and 3, a multipurpose fitness machine in accordance with the present invention, is generally comprised of a bench 1, a supporting frame 2, and an operating frame unit 3.

Referring to FIGS. 1 and 2 again, the bench 1 comprises two raised portions 11 transversely disposed at the top at two opposite ends and adapted for supporting the user's hip or head, two bottom ribs 12 longitudinally disposed at the bottom and having a respective upper straight section 121 and a respective lower oblique section 122 obliquely outwardly extended from the respective upper straight section 121, two lugs 123 respectively connected to the lower oblique sections 122 of the bottom ribs 12 at one end remote from the upper straight section 121, two longitudinal racks 13 respectively fixedly connected to the bottom ribs 12 and defining a respective longitudinal series of retaining notches 131.

Referring to FIG. 1 again, the supporting frame 2 is a U-shaped frame having two opposite ends respectively pivoted to the lugs 123 of the bench 1. The length of the two parallel frame sections 21 of the supporting frame 2 is longer than the length of the bench 1.

Figure 5:
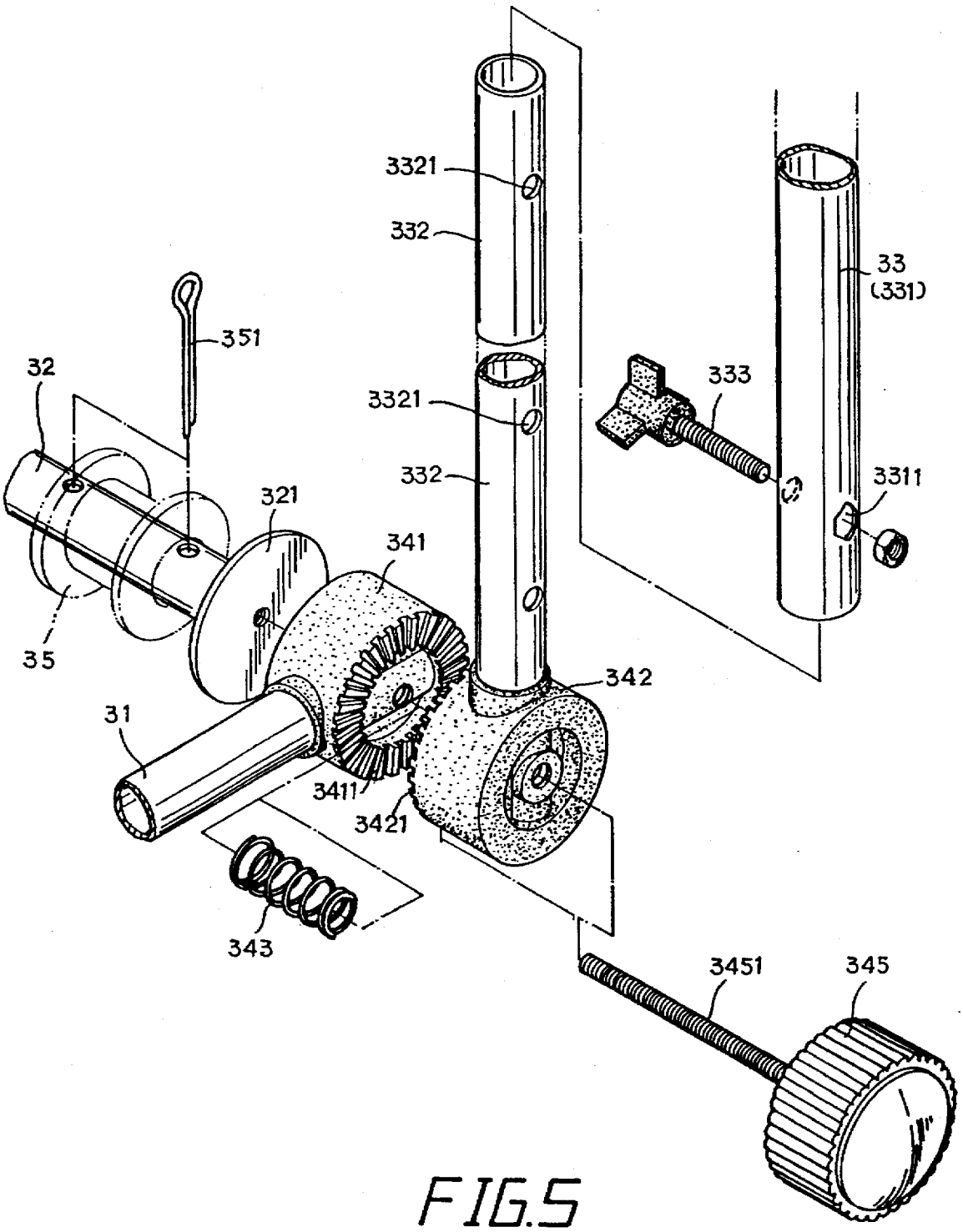
FIG. 5 is an exploded view in an enlarged scale of a ratchet connector according to the present invention.
Figure 6:
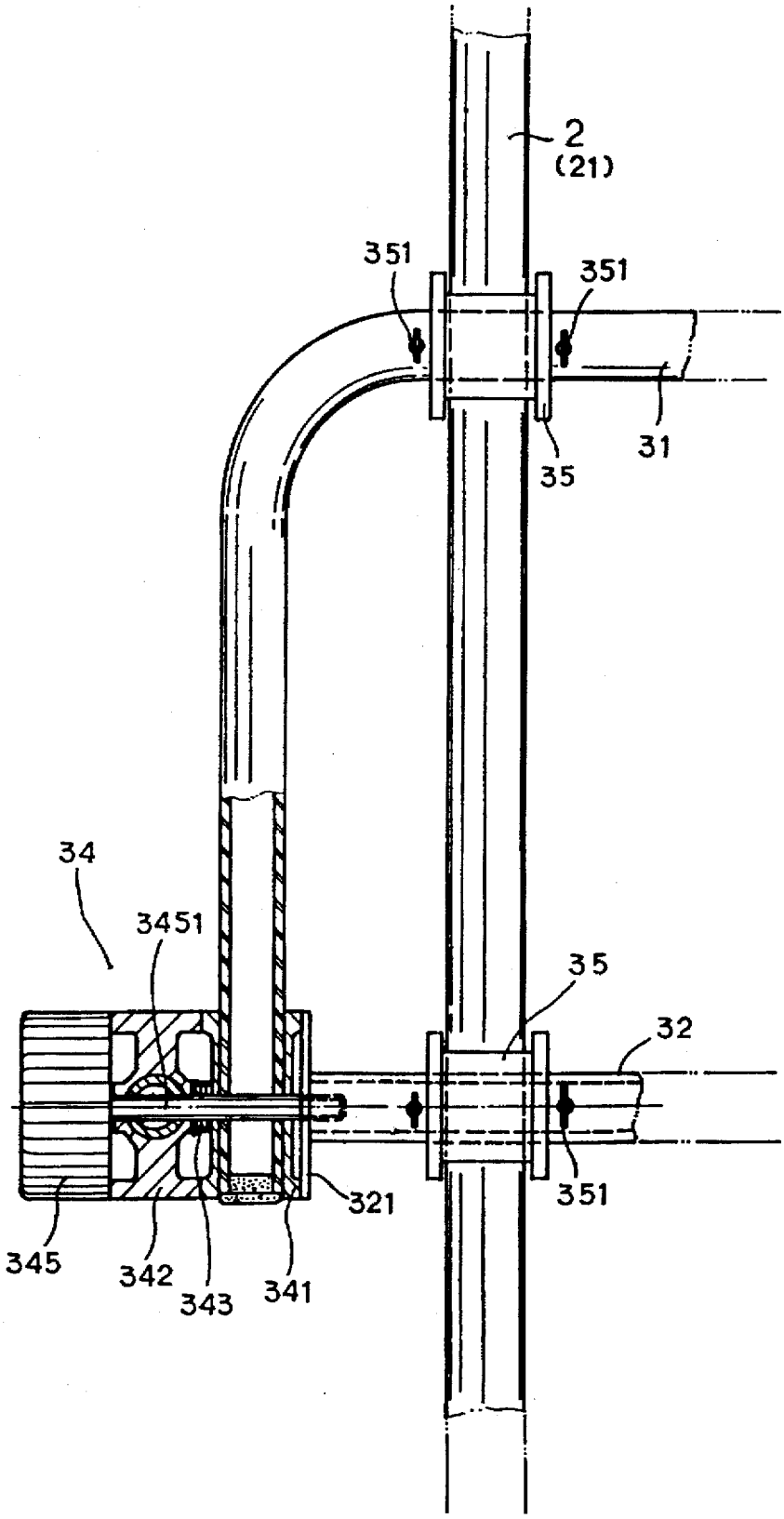
FIG. 6 is a sectional view in an enlarged scale of a part of the operating frame unit according to the present invention.
Figure 7:
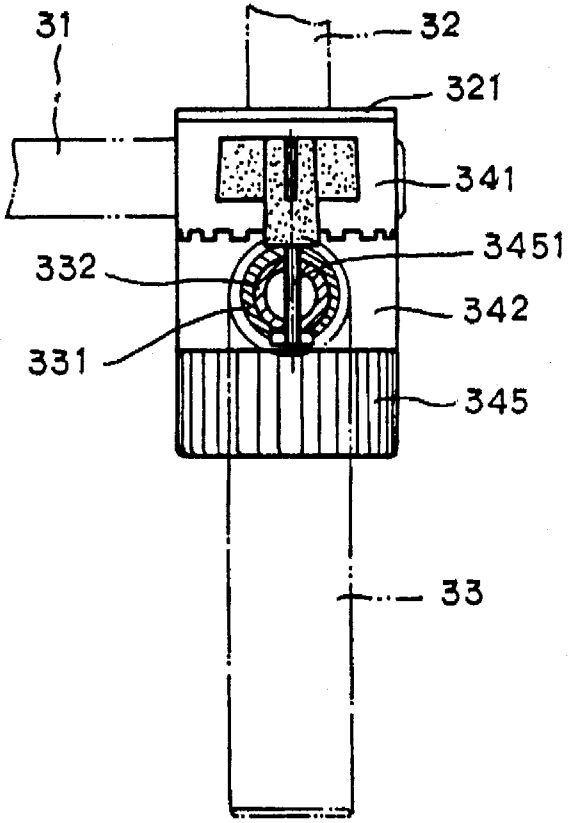
FIG. 7 is a top plain view of the ratchet connector according to the present invention.

Referring to FIGS. from 4 to 7, and FIG. 1 again, the operating frame unit 3 comprises a U-bar 31, a cross bar 32, two oars 33, and a pair of ratchet connectors 34 (see FIG. 5). The cross bar 32 has two flat, circular end piece 321 at two opposite ends. Each of the ratchet connectors 34 comprises a first circular connecting block 341 abutted to one end piece 321 of the cross bar 32 and connected to one end of the U-bar 31 and having radial teeth 3411 at one side opposite to the cross bar 32, a second circular connecting block 342 connected to one oar 33 and having radial teeth 3421 at one side forced into engagement with the radial teeth 3411 of the first circular connecting block 341, a lock screw 345 having a screw body 3451 fastened to the second circular connecting block 342 and the first circular connecting block 341 and the cross bar 32 to fix them together, and a spring 342 mounted around the screw body 3451 of the lock screw 345 and retained between the first circular connecting block 341 and the second circular connecting block 342 to force them apart (see FIG. 6). When the lock screw 345 is loosened, the first circular connecting block 341 and the second circular connecting block 342 are disengaged from each other, and therefore the angular position of the corresponding oar 33 can be adjusted relative to the U-bar 31. When adjusted, the lock screw 345 is screwed up again to fix the oar 33 at the adjusted angle. Each of the oars 33 is comprised of a substantially L-shaped outer tube 331, and a straight inner tube 332. The straight inner tube 332 is connected to the second circular connecting block 342 of one ratchet connector 34, having a plurality of longitudinally spaced transverse through holes 3321. The L-shaped outer tube 331 is slidably sleeved onto the straight inner tube 332, having a transverse through hole 3311 near the bottom end and selectively fastened to one transverse through hole 3321 of the straight inner tube 332 by a screw bolt 333. When the screw bolt 333 is disconnected from the transverse through holes 3321 of the straight inner tube 332, the L-shaped outer tube 331 can be moved relative to the straight inner tube 332 to adjust the length of the respective oar 33 (see FIG. 7). When adjusted, the screw bolt 333 is screwed up again. Further, two pairs of pulleys 35 are respectively fastened to the U-bar 31 and the cross bar 32 by pins 351, and adapted for supporting on the two parallel frame sections 21 of the supporting frame 2 (see FIGS. 1, 5 and 6).

Figure 4:
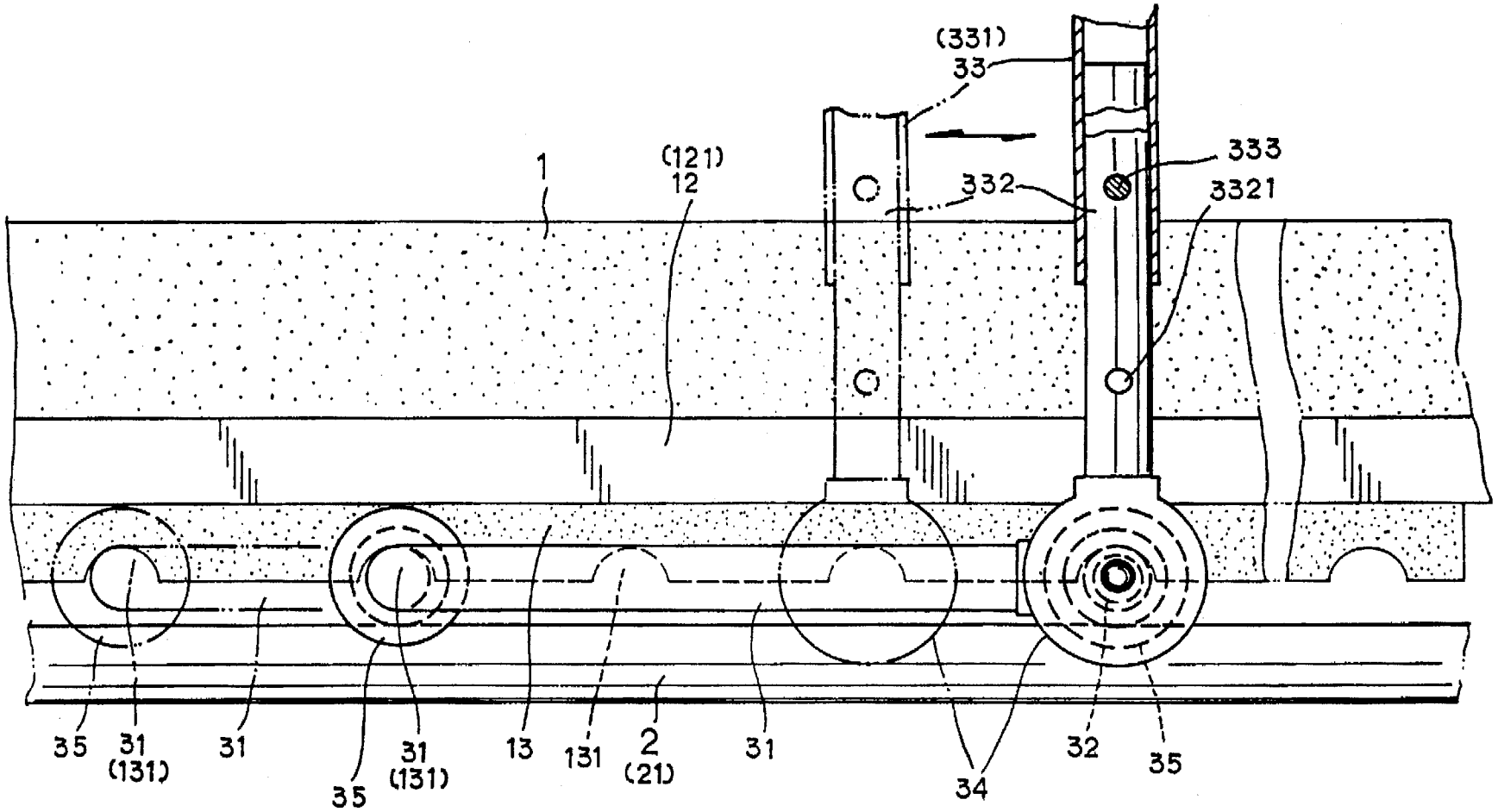
FIG. 4 is another sectional view in an enlarged scale of the present invention, showing the position of the operating frame unit adjusted along the supporting frame.

When in use, the operating frame unit 3 is put on the supporting frame 2, permitting the pulleys 35 to be supported on the parallel frame sections 21 of the supporting frame 2, and then the bench 1 is turned downwardly to the supporting frame 2 to force the notches 131 of the longitudinal racks 13 into engagement with the U-bar 31 and the cross bar 32 (see FIGS. 1, 2, 3 and 6). Before forcing the notches 131 of the longitudinal racks 13 into engagement with the U-bar 31 and the cross bar 32, the operating frame unit 3 can be moved along the parallel frame sections 21 of the supporting frame 2 to the desired location relative to the bench 1 (see FIG. 4). When the oars 33 are pulled, the U-bar 31 is turned upwards to lift the bench 1 (see FIG. 10).

Figure 9:
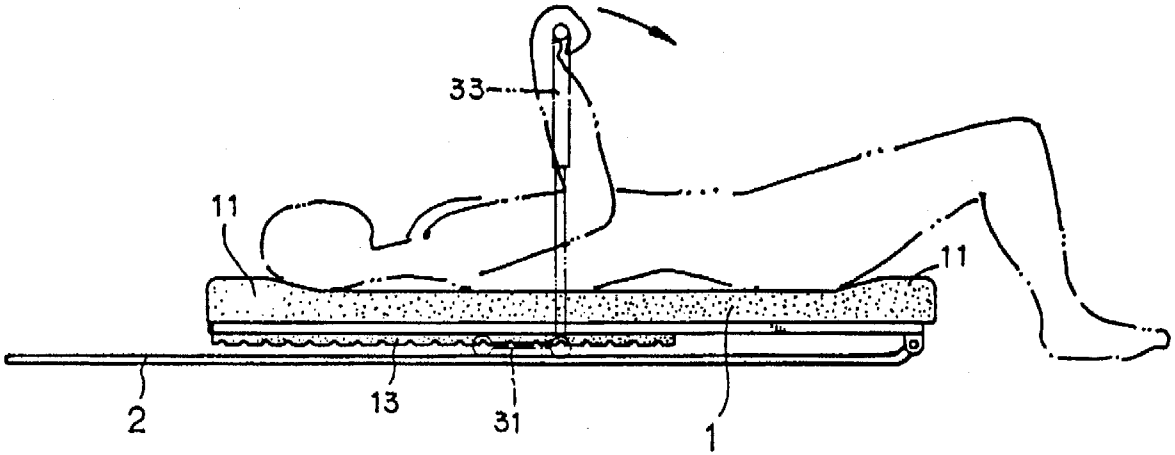
FIG. 9 shows an application example of the present invention.
Figure 12:
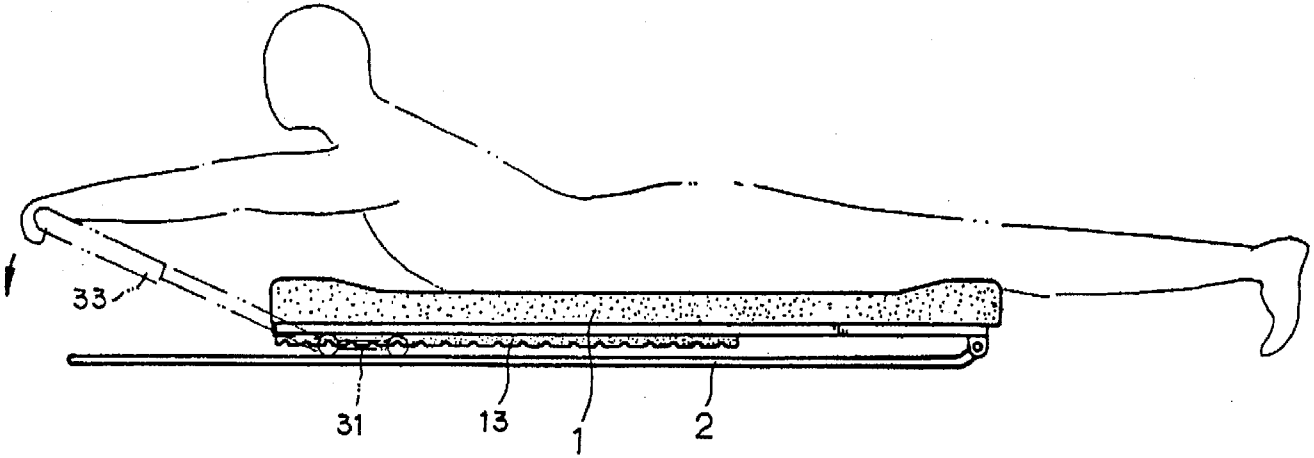
FIG. 12 shows still another application example of the present invention.
Figure 10:
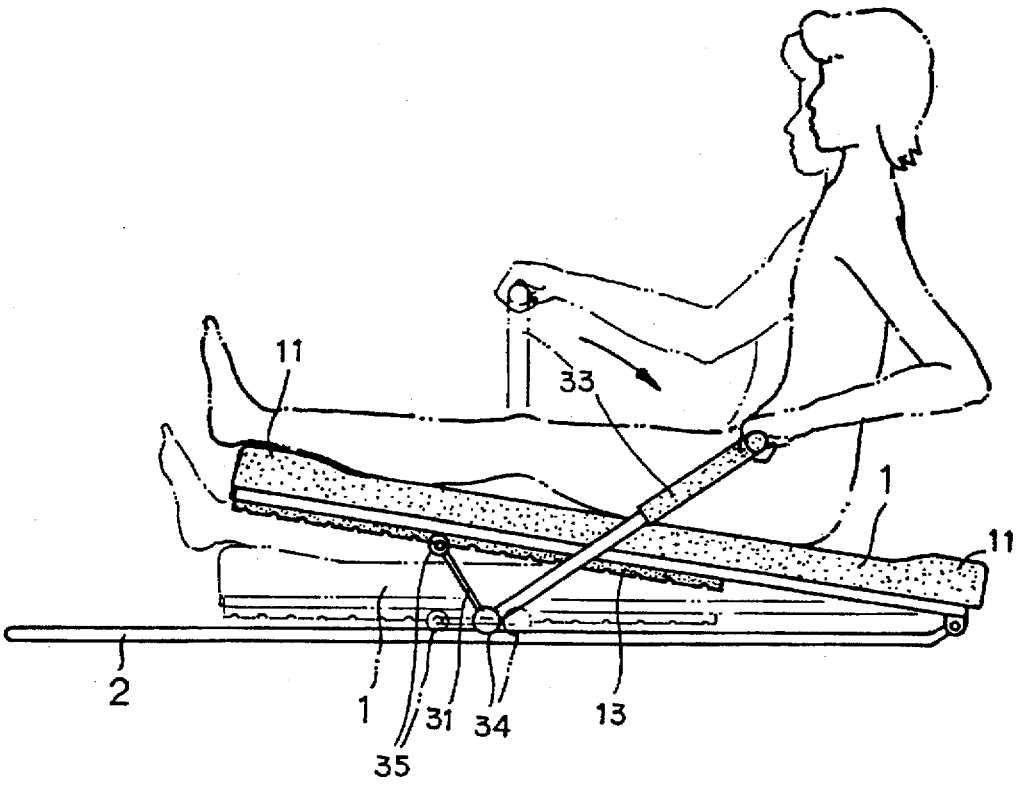
FIG. 10 shows another application example of the present invention.
Figure 11:
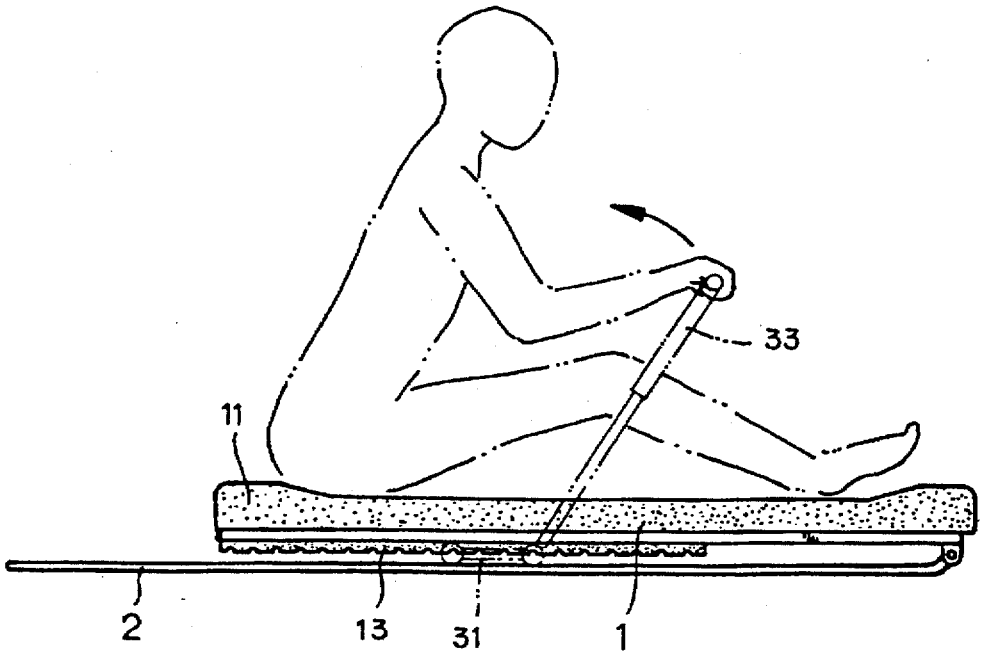
FIG. 11 shows still another application example of the present invention.
Figure 13:
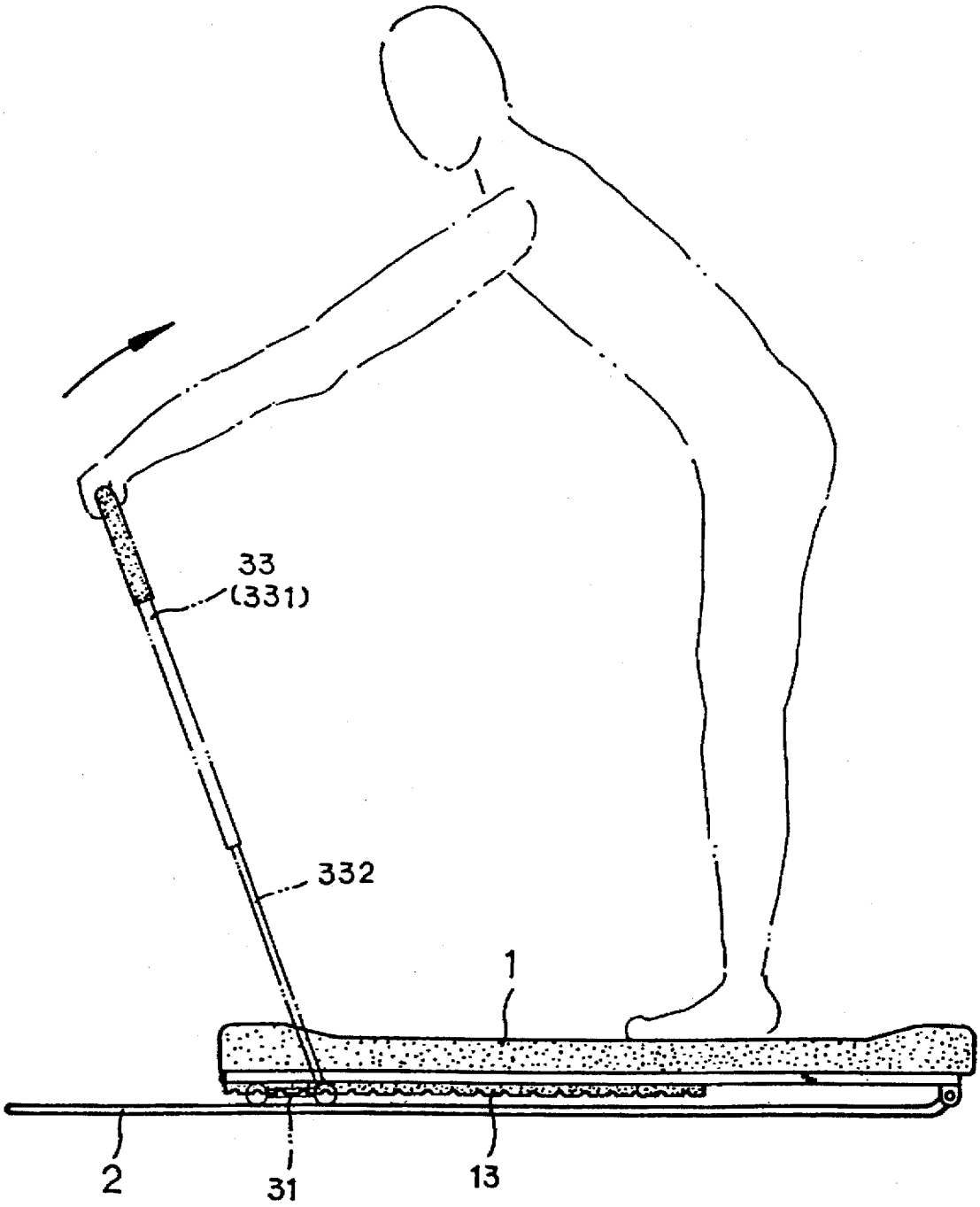
FIG. 13 shows still another application example of the present invention.
Figure 14:
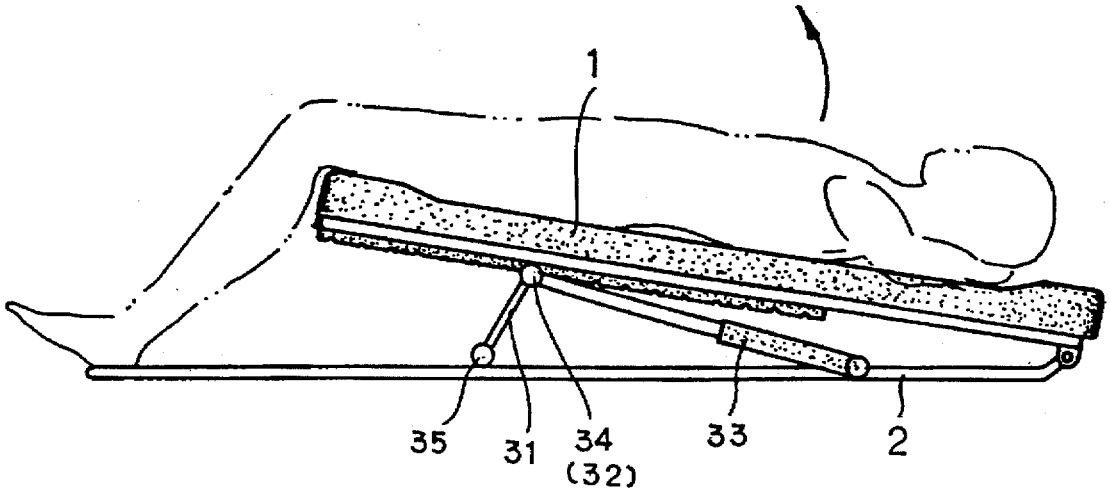
FIG. 14 shows still another application example of the present invention.
Figure 17:
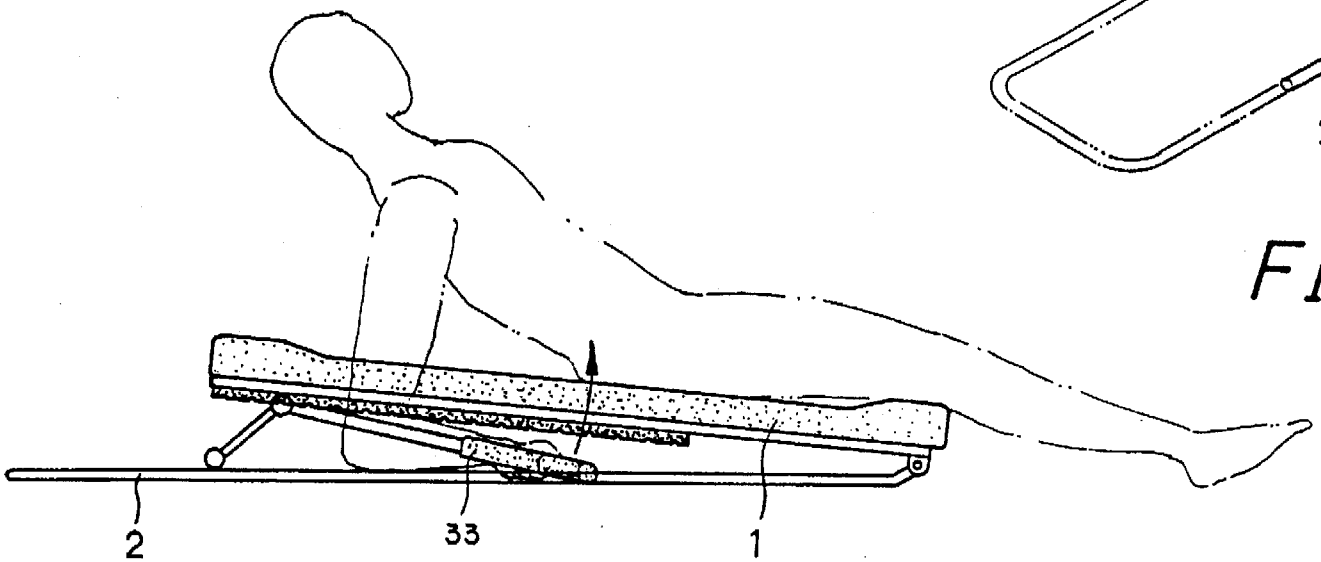
FIG. 17 shows still another application example of the present invention.

FIGS. from 9 to 15 show different application examples of the present invention. FIG. 9 shows the user lay on the bench with the head supported on one raised portion 11 and the hip stopped at the other raised portion 11, and the oars 33 pushed. FIG. 10 shows the user sat on the bench 1, and the oars 33 pulled. FIG. 11 shows the user sat on the bench 1 in the reversed direction, and the oars 33 pulled. FIG. 12 shows the user lay face downwards, and the oars 33 pulled. FIG. 13 shows the user stood on the bench 1, and the oars 33 pulled. FIG. 14 shows the bench 1 supported on the operating frame unit 3 above the supporting frame 2, and the user performed the conditioning exercise of sit-up. FIG. 17 shows the user lay face upwards, and the oars 33 pulled upwards.

Figure 8:
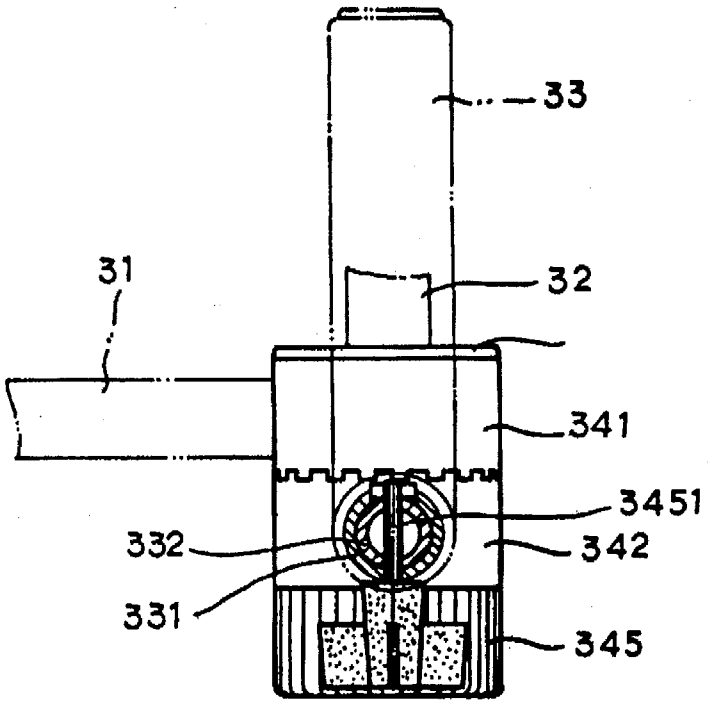
FIG. 8 is similar to FIG. 7 but showing the angular position of the oar changed.
Figure 15:
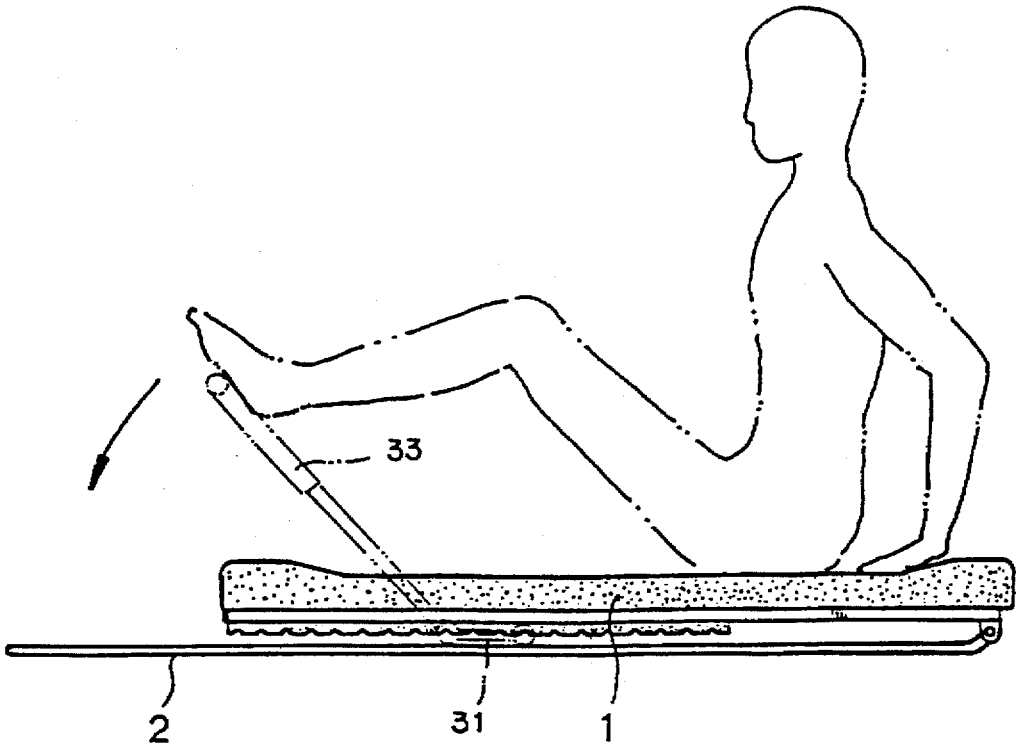
FIG. 15 shows an application example of an alternate form of the multipurpose fitness machine according to the present invention.
Figure 16:
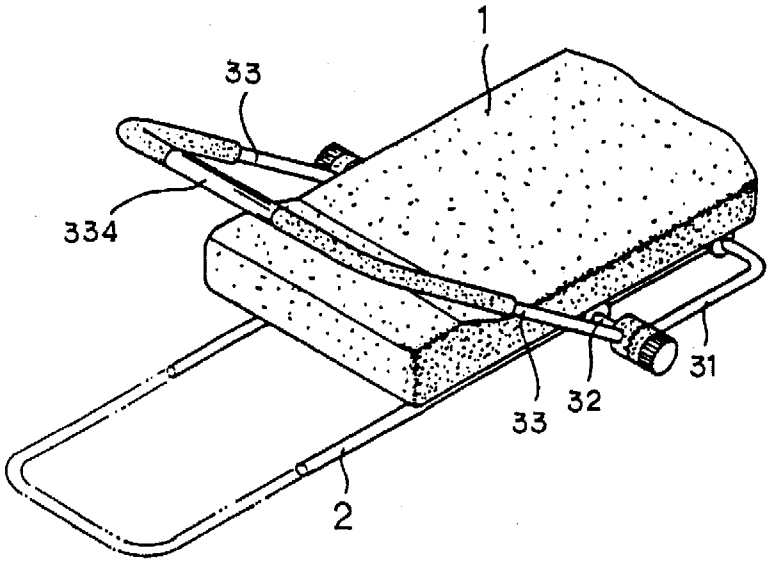
FIG. 16 is an elevational view of the alternate form of the multipurpose fitness machine shown in FIG. 15.

FIGS. 15 and 16 show an alternate form of the present invention, in which a transverse connecting rod 334 is connected between the oars 33 in parallel to the cross bar 32 (see FIG. 16). According to this alternate form, the oars 33 are respectively turned inwards (see FIG. 8). Therefore, the user can sit on the bench 1, with the legs stepped on the transverse connecting rod 334 (see FIG. 16) and pushed (see FIG. 15). Furthermore, the supporting frame 2 can be made retractable, so that the total length of the multipurpose fitness machine can be minimized when not in use.

It is to be understood that the drawings are designed for purposes of illustration only, and are not intended as a definition of the limits and scope of the invention disclosed.

What the invention claimed is:

1. A multipurpose fitness machine comprising:

a substantially U-shaped supporting frame having a transverse frame section and two longitudinal frame sections respectively connected in parallel to two opposite ends of said transverse frame section at right angles;

a bench pivoted to the longitudinal frame sections of said U-shaped supporting frame at one end remote from the transverse frame section of said U-shaped supporting frame, said bench comprising two raised portions transversely disposed at two opposite ends of a top side thereof, two bottom ribs longitudinally disposed at a bottom side thereof and having a respective upper straight section and a respective lower oblique section obliquely outwardly extended from the respective upper straight section and pivoted to one longitudinal frame section of said U-shaped supporting frame, two longitudinal racks respectively fixedly connected to said bottom ribs;

an operating frame unit adapted for supporting said bench on said U-shaped supporting frame for turning by hand to lift said bench from said U-shaped supporting frame, said operating frame comprising a U-bar, a pair of ratchet connectors, a cross bar and two oars respectively connected to two opposite ends of said U-bar by said ratchet connectors, and two pairs of pulleys respectively mounted on said U-bar and said cross bar and adapted for moving said operating frame unit along the longitudinal frame sections of said U-shaped supporting frame and supporting the longitudinal racks of said bench on said U-shaped supporting frame, said cross bar having two flat, circular end piece at two opposite ends, each of said ratchet connectors comprising a first circular connecting block abutted to one end piece of said cross bar and connected to one end of said U-bar and having radial teeth at one side opposite to said cross bar, a second circular connecting block connected to one oar and having radial teeth at one side forced into engagement with the radial teeth of said first circular connecting block, a lock screw fastened to said second circular connecting block and said first circular connecting block and said cross bar to fix them together, and a spring mounted around said lock screw and retained between said first circular connecting block and said second circular connecting block to force them apart.

2. The multipurpose fitness machine of claim 1 wherein each of said oars is comprised of a substantially L-shaped outer tube, and a straight inner tube, said straight inner tube being connected to the second circular connecting block of one ratchet connector, having a plurality of longitudinally spaced transverse through holes, said L-shaped outer tube being slidably sleeved onto said straight inner tube, having a transverse through hole near one end and selectively fastened to one transverse through hole of said straight inner tube by a screw bolt.

3. The multipurpose fitness machine of claim 1 wherein said pulleys are respectively revolvably mounted around the U-bar and cross bar of said operating frame unit, and secured in place by locating pins, said locating pins being respectively fastened to the U-bar and cross bar of said operating frame unit at two opposite sides of each of said pulleys.

4. The multipurpose fitness machine of claim 2 wherein the L-shaped outer tubes of said oars are connected together by a transverse connecting rod.

* * * * *